US007207736B2

(12) United States Patent
Jang

(10) Patent No.: US 7,207,736 B2
(45) Date of Patent: Apr. 24, 2007

(54) PAPER INSERTION LIMITING DEVICE FOR A PAPER FEEDING UNIT

(75) Inventor: Deok-hwan Jang, Suwon (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 10/742,857

(22) Filed: Dec. 23, 2003

(65) Prior Publication Data

US 2004/0136767 A1 Jul. 15, 2004

(30) Foreign Application Priority Data

Dec. 30, 2002 (KR) ..... 10-2002-0086852

(51) Int. Cl.
*B41J 13/26* (2006.01)
*B41J 13/00* (2006.01)

(52) U.S. Cl. ..... 400/630; 400/642; 400/355; 400/631

(58) Field of Classification Search ..... 400/578, 400/642, 630, 55, 59, 579, 632.1, 631, 632, 400/355, 645, 645.3, 645.4, 647, 647.1
See application file for complete search history.

(56) References Cited

U.S. PATENT DOCUMENTS 5,153,736 A * 10/1992 Stemmle ..... 358/296
5,961,224 A 10/1999 Baitz et al. ..... 400/56
6,252,673 B1 6/2001 Miyasaka et al. ..... 358/1.18
6,299,274 B1 * 10/2001 Bolash et al. ..... 347/19
6,422,772 B1 7/2002 Fisher, Sr. et al. ..... 400/629

FOREIGN PATENT DOCUMENTS

EP 0 924 093 A2 6/1999
FR 2 813 820 3/2002

OTHER PUBLICATIONS

Chinese Office Action Issued on Jul. 8, 2005.

* cited by examiner

*Primary Examiner*—Leslie J. Evanisko
(74) *Attorney, Agent, or Firm*—Staas & Halsey LLP

(57) ABSTRACT

A paper insertion limiting device of a paper feeding unit which prevents papers from being inserted to a drive roller when the papers are loaded. The paper insertion limiting device of a paper feeding unit is provided with a sheet regulating member mounted on the front end of the paper feeding unit to rotate by a certain angle, and regulate an insertion depth of papers loaded in the paper feeding unit, and a regulating member activator to actuate the sheet regulating member to block the front ends of papers when the carrier reaches a certain position, and to feed papers when the carrier moves out of the certain position. The sheet regulating member forms a right angle to the face of papers when the carrier reaches the certain position, and the paper regulation member forms an obtuse angle to the papers when the carrier moves out of the certain position.

16 Claims, 9 Drawing Sheets

PAPER INSERTION LIMITING DEVICE FOR A PAPER FEEDING UNIT

CROSS-REFERENCE TO RELATED APPLICATIONS

This application claims the benefit of Korean Application No. 2002-86852, filed Dec. 30, 2002, in the Korean Intellectual Property Office, the disclosure of which is incorporated herein by reference.

BACKGROUND OF THE INVENTION

1. Field of the Invention

The present invention relates to a paper feeding unit of a printer or a multi-function machine, and more particularly, to a paper insertion limiting device of a paper feeding unit which evenly aligns the front ends of papers when the papers are loaded in the paper feeding unit.

2. Description of the Related Art

In general, an automatic sheet feeder (ASF) is mainly employed in a paper feeding unit in an inkjet printer or a multi-function machine. The ASF is provided with a paper insertion limiting device preventing the front ends of papers from being further inserted beyond a certain position since the papers may come out of the certain position and be inserted into a drive roller when the papers are loaded.

FIG. 1 is a view to illustrate a conventional paper insertion limiting device of a paper feeding unit.

In FIG. 1, the paper insertion limiting device of a paper feeding unit includes a gear cam 10, an elevating plate 20, a sheet regulating lever 30, an elevating spring 40, a pushing plate 50, and a pressing plate 60.

The gear cam 10 is coaxially coupled to an idle gear 72 transmitting power to a pickup roller 70, and a hook 12 is formed to press the sheet regulating lever 30 on one end of the gear cam 10. The idle gear 72 and the gear cam 10 are disposed on the same axis, but constructed to be independently driven. A reference number 71 denotes a pickup gear meshed with the idle gear 72 to rotate the pickup roller 70.

The sheet regulating lever 30 is constructed with a lever shaft 31 rotatably mounted on a printer main body (not shown) in which a paper feeding unit is mounted, a lever arm 34 provided on one end of the lever shaft 31 to be pressed down by the hook 12 of the gear cam 10, and a paper wall 32 preventing the front ends of papers loaded in the paper feeding unit from moving forwards.

The elevating plate 20 is disposed under the sheet regulating lever 30, and one end 21 of the elevating plate 20 is rotatably mounted on the printer main body. The other end of the elevating plate 20 is connected with the elevating spring 40 to keep in contact with the one end of the lever arm 34 of the sheet regulating lever 30 all the time. Further, the middle portion 22 of the other end of the elevating plate 20 has the pushing plate 50 and the pressing plate 60 mounted in order. A paper (not shown) is placed on the upper face of the pressing plate 60.

Descriptions will be made below on the operations of the above conventional paper insertion limiting device of a paper feeding unit.

When a motor (not shown) is driven, a driving force is transferred to the gear cam 10 through the idle gear 72 according to a rotation direction of the motor. When the driving force of the motor is transferred to the gear cam 10, the gear cam 10 rotates so that the hook 12 is released from the lever arm 34. When the hook 12 does not press the lever arm 34, the elevating plate 20 rotates, as indicated by the arrow A in FIG. 1, about the rotation shaft 21 by the elevating spring 40. When the elevating plate 20 rotates upwardly, the sheet regulating lever 30 also rotates upwardly so that the paper wall 32 become tilted at a certain angle. At this time, as the middle portion 22 upwardly pushes the pushing plate 50, the pushing plate 50 upwardly pushes the pressing plate 60 (FIG. 2). When the pressing plate 60 is pushed upwardly, papers loaded on the pressing plate 60 come in close contact with the pickup roller 70. At this state, when the pickup roller 70 rotates, a paper is fed by a friction force between the pickup roller 70 and the papers to a drive roller with no interference of the paper wall 32.

When the paper is completely fed, the gear cam 10 rotates again so that the hook 12 presses the lever arm 34 of the sheet regulating lever 30. When the lever arm 34 is pressed, the sheet regulating lever 30 rotates downwardly so that the paper wall 32 returns to its original position to form a right angle (90 degrees) with the face of the loaded papers. Further, when the lever arm 34 is pressed, the elevating plate 20 positioned under the lever arm 34 is also pressed down so that the elevating plate 20 rotates downwardly to its original position with the elevating spring 40 expanded. Thereafter, the pushing plate 50 and the pressing plate 60 rotate downwardly by weight of their own to their original positions so that the pickup roller 70 and the papers fall apart from each other. That is, when the paper wall 3 is tilted by a certain angle from a right angle by the rotations of the gear cam 10, the papers and the pickup roller 70 come in contact with each other thereby feeding a paper, and, when the gear cam 10 rotates more, the paper wall 32 returns to be at a right angle to a paper to block the front ends of the papers so that the papers loaded in the paper feeding unit are prevented from being inserted into the drive roller.

However, the above paper insertion limiting device of a paper feed unit has various problems as follows.

First, since such paper insertion limiting device has a complicated structure and lots of parts, the manufacturing costs are high. Second, noise is produced since the elevating plate repeats its ascent and descent operations every time a paper is picked up. Third, a paper-sliding prevention member is positively necessary since the papers loaded on the pressing plate are easily slid back with the repetitive ascent and descent of the pressing plate. Fourth, the reliability on paper pickup operations is degraded since the paper pickup condition is not the same all the time.

SUMMARY OF THE INVENTION

A first aspect of the present invention provides a paper insertion limiting device of a paper feeding unit having a simplified structure thereby being less costly.

It is a second aspect of the present invention to provide a paper insertion limiting device of a paper feeding unit having little noise.

It is a third aspect of the present invention to provide a paper insertion limiting device of a paper feeding unit having similar paper pickup condition at all times.

It is a fourth aspect of the present invention to provide a paper insertion limiting device of a paper feeding unit having little need to additionally control a motor to load papers.

In order to achieve the above objects, there is provided a paper insertion limiting device of a paper feeding unit, using a movement of a carrier which is mounted with an ink cartridge moving to the left and right to print. The paper insertion limiting device comprises a sheet regulating member mounted on the front end of the paper feeding unit to regulate an insertion depth of papers loaded in the paper feeding unit, and a regulating member activator to actuate the sheet regulating member to block the front ends of papers when the carrier reaches a certain position, and to feed papers when the carrier moves out of the certain position.

The certain position is a home position where the carrier is placed while waiting to print.

In order to achieve the above aspects, there is provided a paper insertion limiting device of a paper feeding unit, using a carrier which is mounted with an ink cartridge and moving to the left and right to print. The paper insertion limiting device comprises a sheet regulating member mounted on the front end of the paper feeding unit to rotate by a certain angle and regulate an insertion depth of papers loaded in the paper feeding unit, and a regulating member activator to actuate the sheet regulating member to block the front ends of papers when the carrier reaches a certain position, and to feed papers when the carrier moves out of the certain position.

The sheet regulating member forms a right angle to the face of papers when the carrier reaches the certain position, and the paper regulation member forms an obtuse angle to the papers when the carrier moves out of the certain position.

The certain position is a home position where the carrier is placed while waiting to print.

Further, in order to achieve the above aspects, there is provided a paper insertion limiting device of a paper feeding unit which is mounted to the main body of a printer having a carrier with an ink cartridge mounted thereon moving to the left and right to print. The paper insertion limiting device comprises a sheet regulating member mounted on the front end of the paper feeding unit to rotate by a certain angle and regulate an insertion depth of papers loaded in the paper feeding unit, and a regulating member activator rotatably mounted on the main body in which the paper feeding unit is mounted, with one end connected to the sheet regulating member and the other end actuated by the carrier. The regulating member activator rotates to a certain angle so that the sheet regulating member is placed to block the front ends of papers when the carrier reaches a home position, and the sheet regulating member is placed to feed papers when the carrier moves out of the home position.

The sheet regulating member includes a lever shaft rotatably mounted on the front end of the paper feeding unit, a lever arm protruded from the lever shaft and connected to one end of the regulating member activator, and a paper wall formed from the lever shaft to block the front ends of papers when the carrier enters the home position, and feed the papers when the carrier moves out of the home position.

A guide pin is provided on the lever arm of the sheet regulating member, and one end of the regulating member activator is provided with a guide slit, and the guide pin is inserted in the guide slit, and a spring is mounted on the bottom of the lever arm.

A cam is formed on the other end of the regulating member activator to rotate the regulating member activator to a certain angle according to movements of the carrier, and an actuating pin is mounted on the carrier to actuate the cam, preferably. The sheet regulating member forms a right angle to the face of papers when the actuating piece actuates the cam, and the sheet regulating member forms an obtuse angle with the face of papers when the actuating piece is separated from the cam.

Further, the regulating member activator includes a cam gear mounted in parallel with a movement direction of the carrier to be operated by the carrier, a first rack gear meshed with the cam gear to convert rotation movements of the cam gear into linear movements, a lever rotatably mounted on the main body in which the paper feeding unit is mounted, having one end connected to the first rack gear to convert the linear movements of the first rack gear into rotational movements, a second rack gear connected to the other end of the lever to convert the rotational movements of the lever into the linear movements, a regulating gear meshed with the second rack gear to convert the linear movements of the lever into the rotational movements, and a paper wall mounted in line of an axis of the regulating gear to block the front ends of papers according to rotations of the regulating gear, the paper wall being placed to block the front ends of papers when the carrier enters the home position and to feed paper when the carrier moves out of the home position.

In an aspect of the invention the carrier has a cam follower to rotate the cam gear.

In order to achieve the above aspects, there is provided a paper insertion limiting device of a paper feeding unit, using a carrier which is mounted with an ink cartridge and moving to the left and right to print. According to another embodiment, the paper insertion limiting device comprises a sheet regulating member mounted on the front end of the paper feeding unit to move back and forth to a certain distance, and regulate an insertion depth of papers loaded in the paper feeding unit, and a regulating member activator to actuate the sheet regulating member to block the front ends of papers when the carrier reaches a certain position, and to feed papers when the carrier moves out of the certain position.

In the paper insertion limiting device of a paper feeding unit, the sheet regulating member moves to be placed in line of a paper dam of the paper feeding unit when the carrier enters the certain position, and moves back so as to not interact with the papers when the carrier moves out of the certain position.

Further, a paper insertion limiting device of a paper feeding unit mounted to the main body of a printer having a carrier with an ink cartridge mounted thereon moving to the left and right to print comprises a sheet regulating member mounted on the front end of the paper feeding unit to move back and forth to a certain distance and regulate an insertion depth of papers loaded in the paper feeding unit, and a regulating member activator rotatably mounted on the main body in which the paper feeding unit is mounted, with one end being connected to the sheet regulating member, and the other end actuated by the carrier. The regulating member activator rotates to a certain angle so that the sheet regulating member is placed to block the front ends of papers when the carrier enters a home position, and the sheet regulating member is placed to feed papers when the carrier moves out of the home position.

The sheet regulating member includes a lever shaft rotatably mounted on the front end of the paper feeding unit, a lever arm protruded from the lever shaft and connected to one end of the regulating member activator, and a paper wall formed to move forth so as to be placed in line of a paper dam of the paper feeding unit to block the front ends of papers when the carrier enters the home position, and to move back to feed papers when the carrier moves out of the home position.

A guide pin is provided on the lever arm of the sheet regulating member, and one end of the regulating member activator is provided with a guide slit, and the guide pin is inserted in the guide slit. Further, a spring is mounted on the bottom of the lever arm.

Further, the sheet regulating member further includes cam grooves formed on the lower side of the paper wall, lever cams protruded from the lever shaft, and inserted in the cam grooves to move the paper wall forth. A spring is included in the paper wall between the paper wall and the paper dam. In particular, a resistance layer is formed on a paper-contacting face of the paper wall to resist paper insertions. The resistance layer is preferably formed with a plurality of protrusions.

Accordingly, with the paper insertion limiting device of a paper feeding unit according to the present invention as above, the manufacturing costs can be lowered due to the simplified structure.

Further, the present invention can provide the paper insertion limiting device of a paper feeding unit having no noise and the same pickup condition at all times.

Further, the present invention can provide the paper insertion limiting device of a paper feeding unit having no need to additionally control a motor to load papers.

Additional and/or other aspects and advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE PREFERRED EMBODIMENTS

Figure 1:
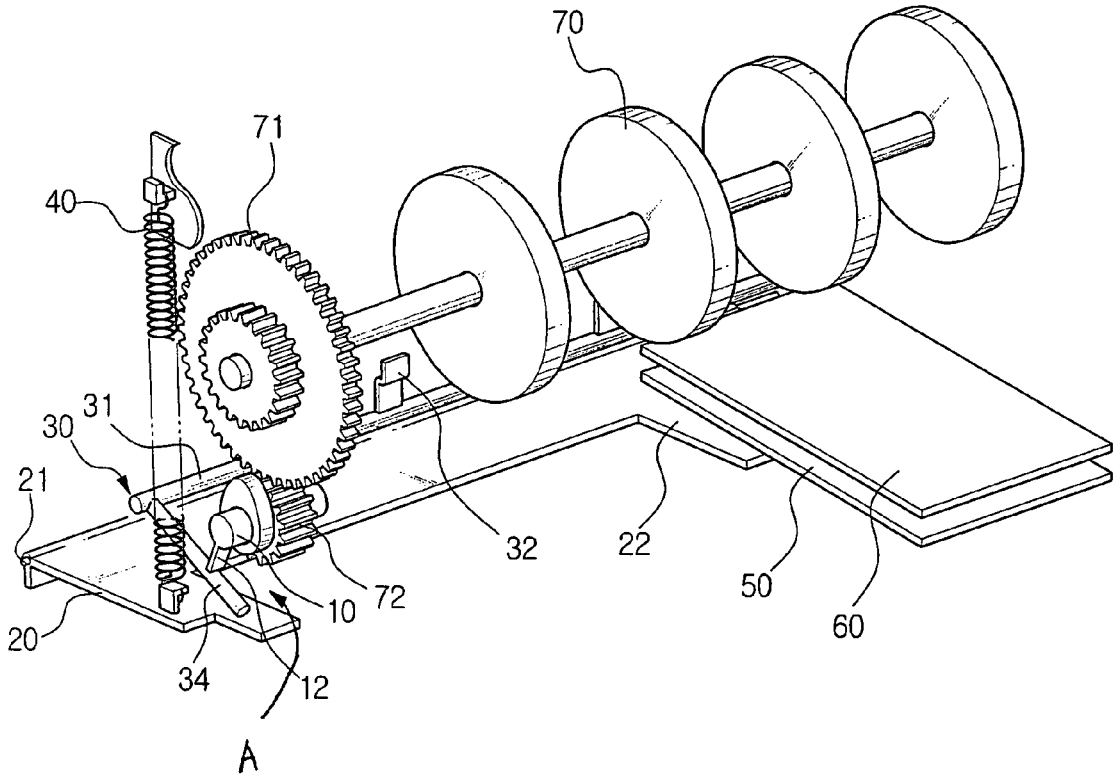
FIG. 1 (PRIOR ART)
FIG. 1 is a perspective view for showing a conventional paper insertion limiting device for a paper feeding unit.
Figure 2:
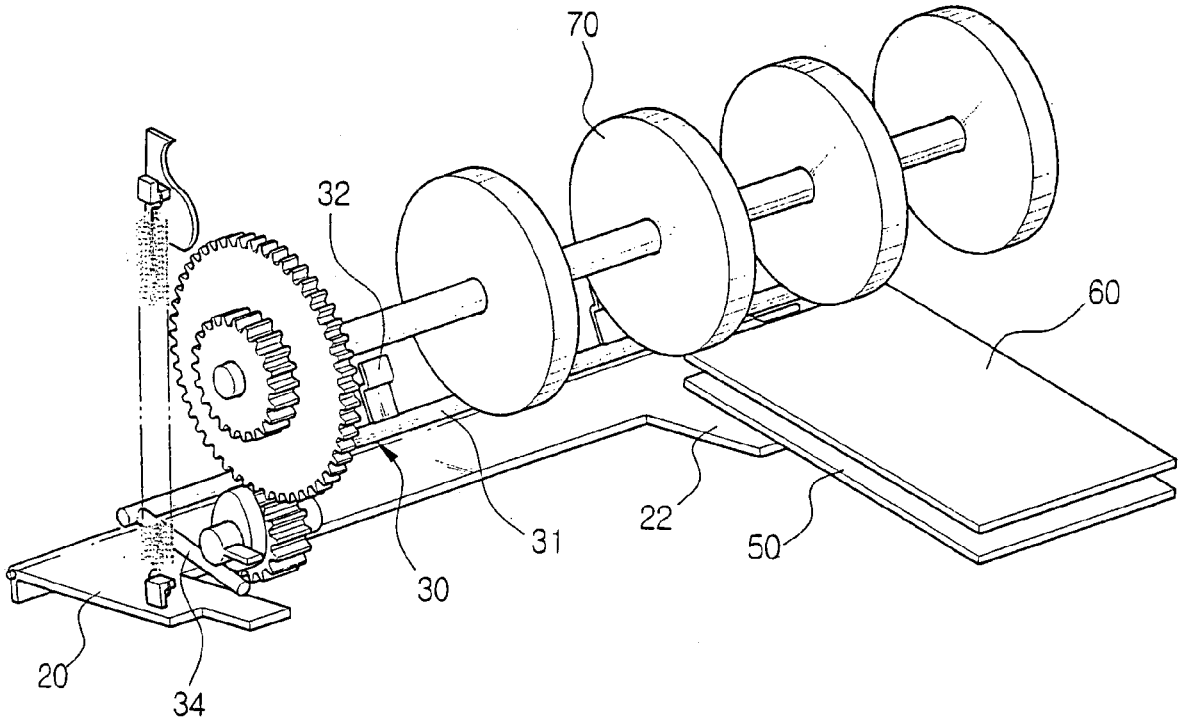
FIG. 2 (PRIOR ART)
FIG. 2 is a perspective view for showing a state that a sheet regulating lever is in a paper feeding position in the paper insertion limiting device of FIG. 1.

Reference will now be made in detail to the embodiments of the present invention, examples of which are illustrated in the accompanying drawings, wherein like reference numerals refer to the like elements throughout. The embodiments are described below in order to explain the present invention by referring to the figures.

Referring to FIG. 3 to FIG. 6, a paper insertion limiting device of a paper feeding unit according to the present invention includes a sheet regulating member 100 and a regulating member activator 200.

The sheet regulating member 100 prevents papers (not shown) loaded in the paper feeding unit 300 from being inserted into a drive roller 320, which includes a lever shaft 101, a lever arm 103, and a paper wall 106.

The lever shaft 101 is rotatably mounted on the front end of the paper feeding unit 300, and the lever arm 103 is installed to be protruded on one end of the lever arm 103. The lever arm 103 is activated by the regulating member activator 200, and activates the lever shaft 101 to revolve in a certain angle range. A guide pin 105 is formed on the front end of the lever arm 103, and engaged in a guide slit 205 formed on the one end portion of the regulating member activator 200. Further, biasing element 110, such as a spring, is mounted on the bottom of the front end of the lever arm 103 to bias and upwardly support the lever arm 103.

The paper wall 106 is protrudedly mounted on the lever shaft 101, and blocks the front ends of papers loaded in the paper feeding unit 300 not to be inserted into the drive roller 320. Accordingly, the paper wall 106 is spaced at a certain interval away from the lever arm 103 to effectively prevent the front ends of papers from being fed to the drive roller 320. One paper wall 106 can be provided, but two or more paper walls may be provided. Further, the paper wall 106 is formed not to interfere with the feeding of papers since the paper wall 106 rotates in the counterclockwise direction as shown by an arrow A1 (FIG. 3) by the biasing element 110 in case that the regulating member activator 200 does not apply a force to the lever arm 103 so that a paper dam 310 of the paper feeding unit 300 rotates over an angle formed with the papers. That is, the sheet regulating member 100 is positioned at a paper feeding position P2 (FIG. 6) to allow papers to be fed. At the same time, the paper wall 106 is formed to have a right angle to the faces of papers loaded in the paper feeding unit 300 in case that the lever arm 103 is activated by the regulating member activator 200. That is, the sheet regulating member 100 is located at a regulating position P1 (FIG. 3) to prevent the loaded papers from being fed to the drive roller 320.

Figure 4:
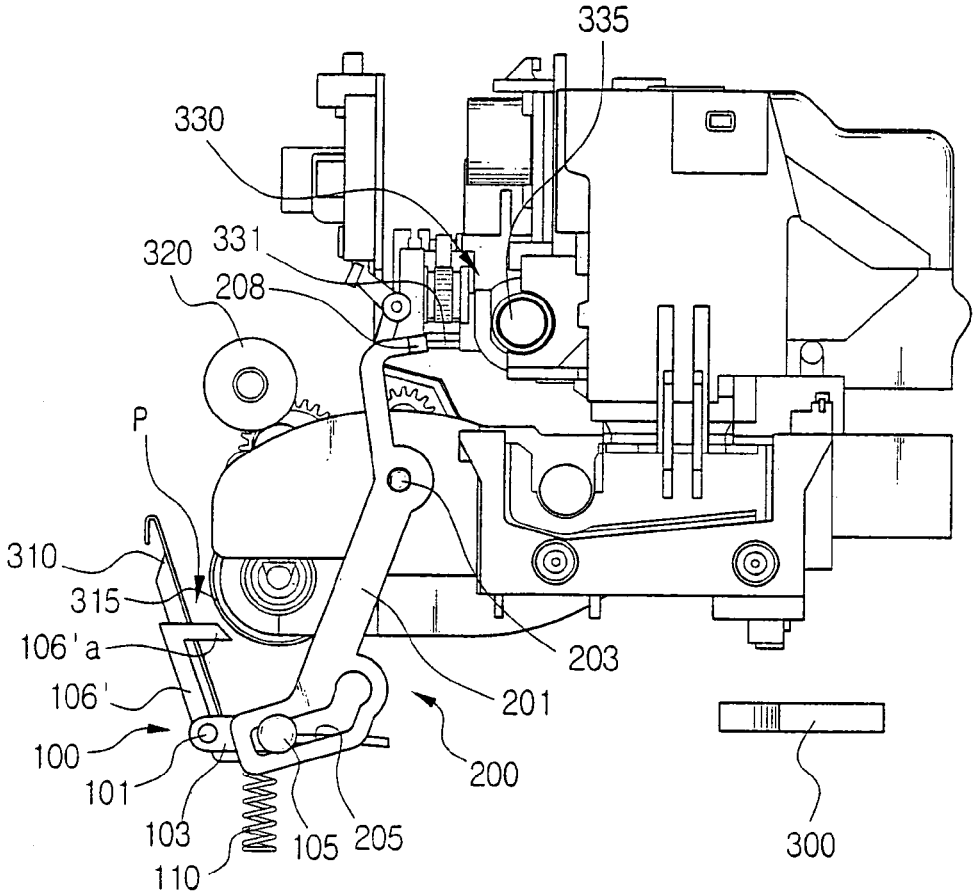
FIG. 4 is a side view for showing another paper wall of the paper insertion limiting device of FIG. 3.

Another embodiment of the paper wall is to form one end of the paper wall in a "L" shape as shown in FIG. 4. Here, the paper wall 106' is formed to prevent the front ends of papers from being fed to the drive roller 320, since the front end 106'*a* of the paper wall completely escapes from a paper feeding path P (FIG. 4) when the regulating member activator 200 does not apply a force to the lever arm 103. Conversely, the front end 106'*a* of the paper wall blocks the paper feeding path P when the regulating member activator 200 applies a force to the lever arm 103.

Figure 3:
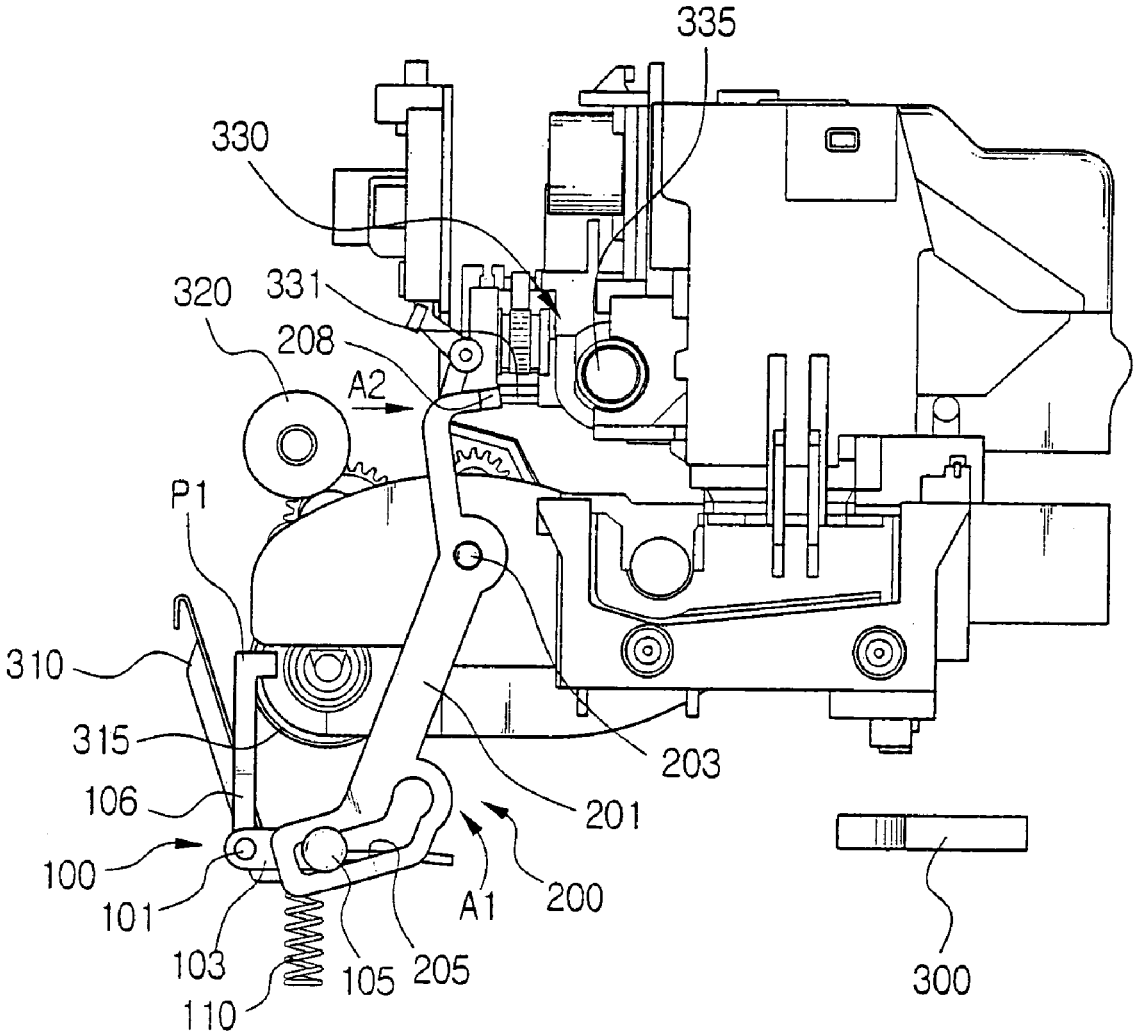
FIG. 3 is a side view for showing a paper insertion limiting device for a paper feeding unit according to a first embodiment of the present invention.
Figure 5:
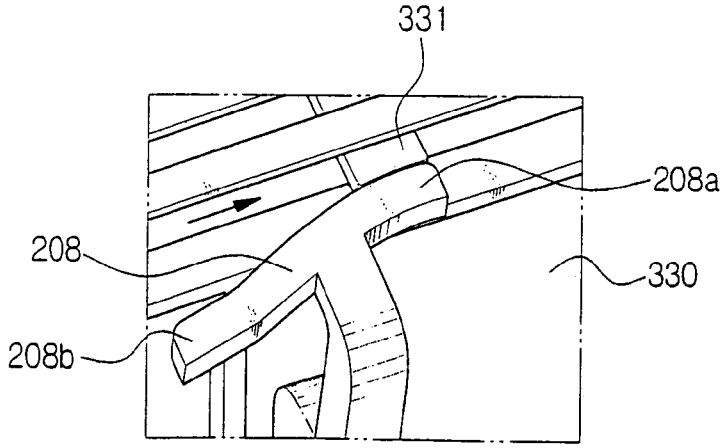
FIG. 5 is a partial perspective view for showing relations between an operation plate and a cam in the paper insertion limiting device of FIG. 3.

The regulating member activator 200 activates the sheet regulating member 100 as a carrier 330 comes at a certain position, which is a lever 201 mounted on the main body of an inkjet printer to rotate by a pivot 203. The guide slit 205 is formed in one end of the regulating member activator 200 so that the guide pin 105 of the lever arm 103 can be inserted and guided. A cam 208 is formed that can convert linear movements of the carrier 330 into rotational movements of the lever 201 on the other end of the regulating member activator 200. The carrier 330, moving to the left and right along a guide bar 335, let an inkjet printer head mounted therein to fire ink to print on papers fed from the paper feeding unit 300, which has an activating piece at a position corresponding to the cam 208 formed on the other end of the regulating member activator 200. The cam 208 and the actuating piece 331 are illustrated in FIG. 5. In FIG. 5, the cam 208 is spaced from the carrier 330 in a short distance at a position 208*a* corresponding to the home position of the carrier 330, and spaced from the carrier 330 in a long distance at a position 208*b* to which the actuating piece 331 moves. Accordingly, when the carrier 330 moves in the arrow direction, the actuating piece 331 comes in contact with the cam 208 to push the cam 208 in a vertical direction with respect to a movement direction of the carrier 330 as shown by an arrow (FIG. 5). Thereafter, as shown in FIG. 3, the regulating member activator 200 rotates in the counterclockwise direction. That is, the linear movements of the carrier 330 are converted into the rotational movements of the regulating member activator 200 by the cam 208 and the actuating piece 331.

A certain position at which the carrier 330 operates the regulating member activator 200 is set at the home position in which the carrier 330 stays without printing on papers. The home position refers to a position setting of the carrier 330 to stay where electric power is not supplied to an inkjet printer or the inkjet printer does not perform printing in the power-on state, and where, in general, papers are loaded into the paper feeding unit 300 at this time.

The paper feeding unit 300 in which a paper insertion limiting device of the paper feeding unit 300 is mounted has a pressing plate (not shown) and a paper dam 310. The pressing plate loads papers thereon, and pushes the loaded papers to a pickup roller 315 so that a friction force is applied between the pickup roller 315 and the papers to feed a paper toward a drive roller 320 by the pickup roller 315. The paper dam 310 is mounted at the front end of the paper feeding unit 300, that is, at one side of the sheet regulating member 100, and plays a role of separating papers one by one that are fed by the pickup roller 315.

Hereinafter, the operations of the paper insertion limiting device of the paper feeding unit as above according to the first embodiment of the present invention will be described with reference to FIG. 3 to FIG. 6 out of the accompanying drawings.

Figure 6:
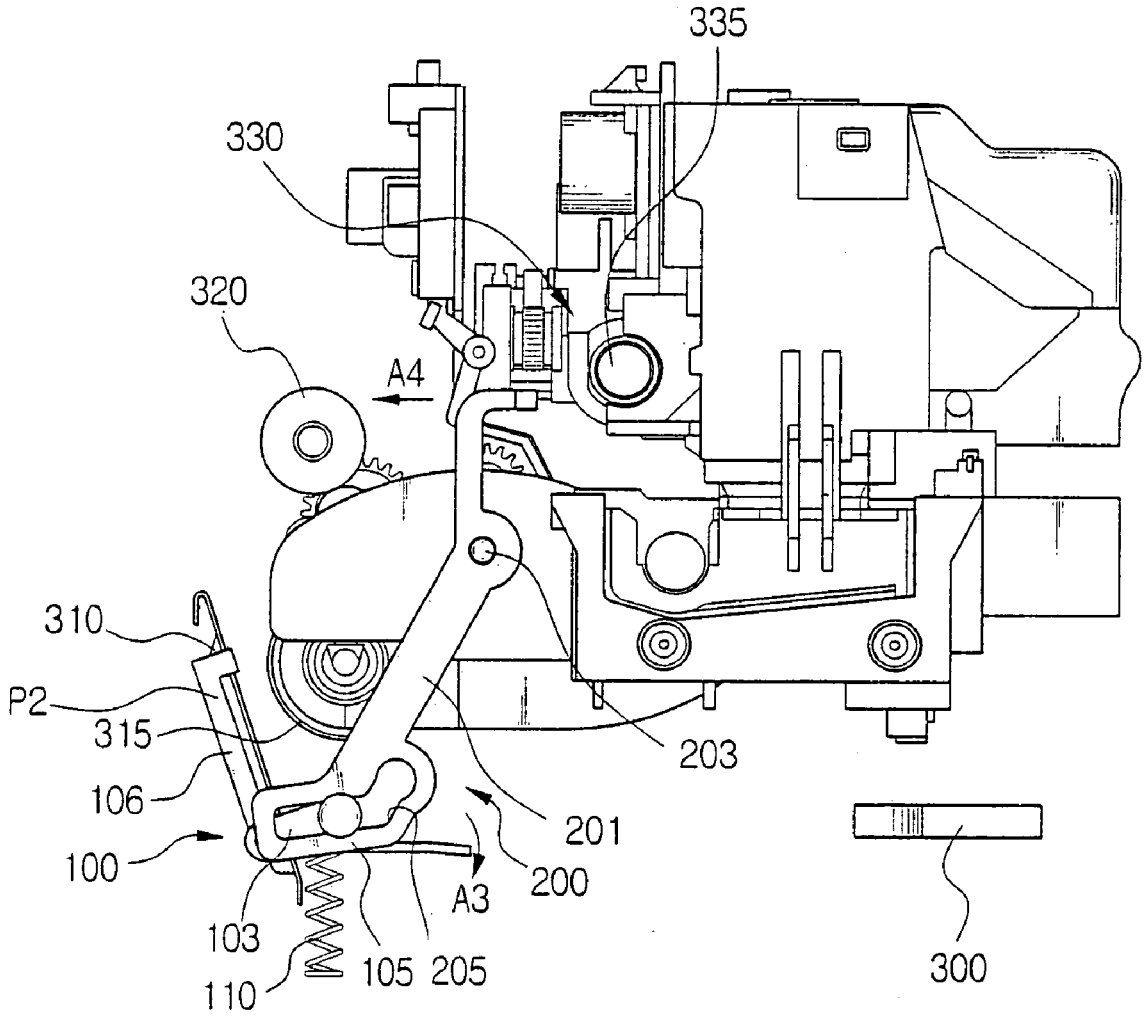
FIG. 6 is a side view for showing a state that a sheet regulating member is in a paper feeding position in the paper insertion limiting device of FIG. 3.

First, when papers are loaded into the paper feeding unit 300 of an inkjet printer, the carrier 330 moves to the home position. When the carrier 330 reaches the home position, the actuating piece 331 pushes the cam 208 of the regulating member activator 200 to the left direction as shown by an arrow A4 (FIG. 6). When the cam 208 is pushed to the left, the regulating member activator 200 rotates in the counterclockwise direction about the pivot 203. When the regulating member activator 200 rotates to the counterclockwise direction, the guide pin 105 of the sheet regulating member 100 inserted in the guide slit 205 is pressed down as shown by an arrow A3 (FIG. 6). When the guide pin 105 is pressed down by the guide slit 205, the spring 110 positioned underneath the lever arm 103 is pressed so that the sheet regulating member 100 rotates in the clockwise direction. When the sheet regulating member 100 rotates in the clockwise direction, the paper wall 106 is positioned at P1 where the paper wall 106 forms a right angle to the face of the papers loaded in the paper feeding unit 300, so that the loaded papers are prevented from being inserted to the drive roller 320 (FIG. 3). When the paper wall 106' has a shape shown in another embodiment of FIG. 4, the front end 106'*a* of the paper wall blocks the paper feeding path P so that the front ends of the papers are prevented from being inserted to the drive roller 320.

When the carrier 330 moves to print with the load of papers completed, the carrier 330 comes out of the home position. When the carrier 330 comes out of the home position, the actuating piece 331 is separated from the cam 208. When the actuating piece 210 is released from the cam 208, the lever arm 103 of the sheet regulating member 100 rotates in the counterclockwise direction as shown by an arrow A1 (FIG. 3) by a restoration force of the spring 110 compressed through the regulating member activator 200. When the lever arm 103 rotates in the counterclockwise direction, the paper wall 106 forms with the face of the papers an angle larger than an angle that the paper dam 310 of the paper feeding unit forms with the paper wall, so that the loaded papers are picked up by the pickup roller 315, separated paper by paper by the paper dam 310, and fed to the drive roller 320. When the lever arm 103 rotates in the counterclockwise direction by the spring 110, the regulating member activator 200 rotates in the clockwise direction as shown by an arrow A2 (FIG. 3) by the guide pin 105 and the guide slit 205 so that the cam 208 is prepared to come in contact with the actuating piece 331 (FIG. 6).

When the carrier 330 finishes the printing and returns to the home position, the actuating piece 331 actuates the cam 208 again so that the paper wall 106 blocks the front ends of papers through the above operations.

Figure 7:
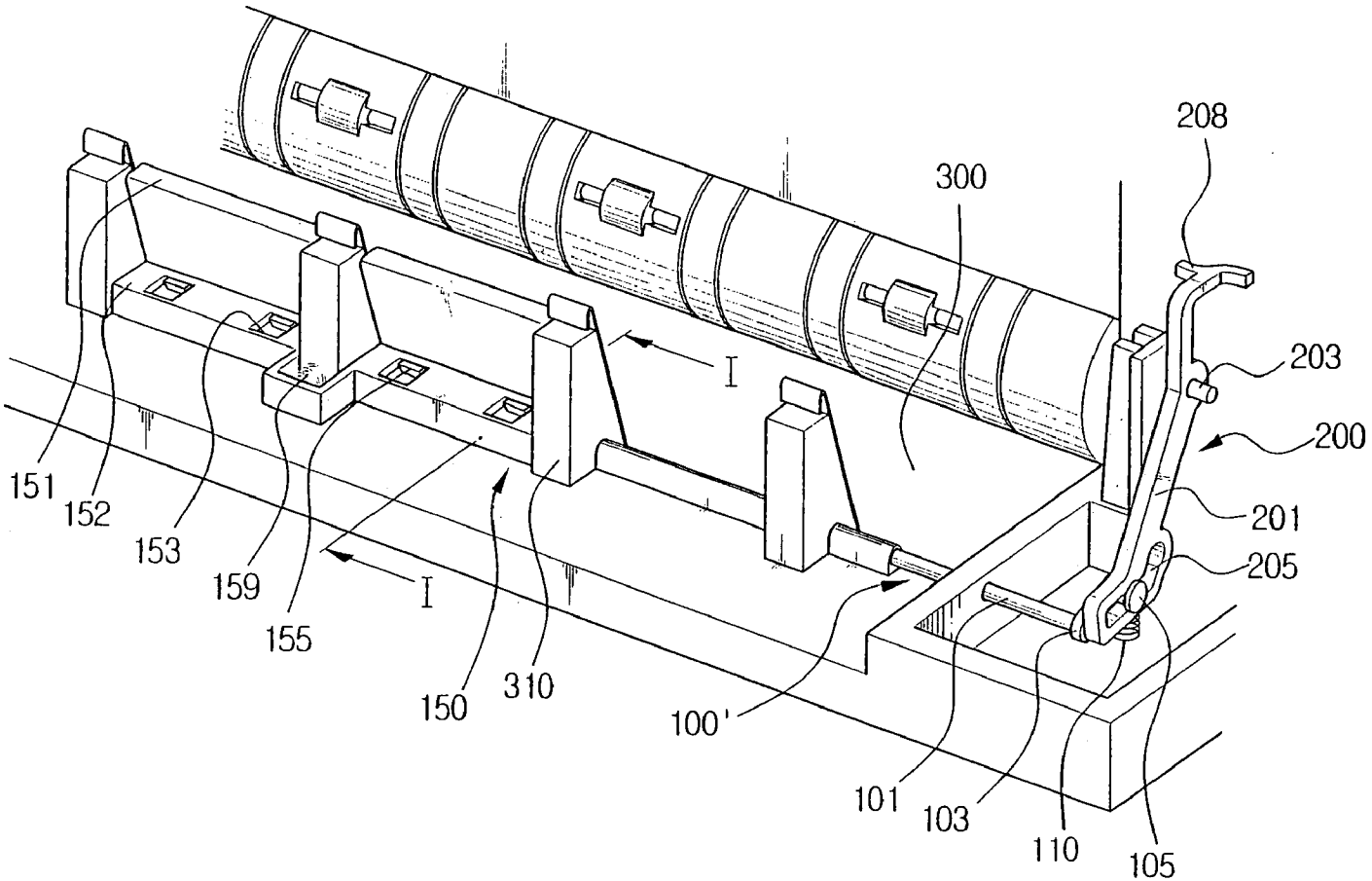
FIG. 7 is a perspective view for showing a paper insertion limiting device for a paper feeding unit according to a second embodiment of the present invention.

Further, FIG. 7 is a view to show a paper insertion limiting device of a paper feeding unit according to a second embodiment of the present invention.

In FIG. 7, the paper insertion limiting device of a paper feeding unit according to the second embodiment includes a sheet regulating member 100' and the regulating member activator 200.

The sheet regulating member 100' is to prevent the papers (not shown) loaded in the paper feeding unit 300 from being inserted to the drive roller 320 (FIG. 6), which has the lever shaft 101, lever arm 103, and paper wall 150.

The lever shaft 101 is rotatably mounted to the front end of the paper feeding unit 300, and the lever arm 103 is installed to be protruded on one end of the lever arm 103. The lever arm 103 is activated by the regulating member activator 200, and activates the lever shaft 101 to rotate in a certain angle range. A guide pin 105 is formed on the front end of the lever arm 103, and engaged in the guide slit 205 formed on the one end portion of the regulating member activator 200. Further, the biasing element 110 is mounted on the bottom of the front end of the lever arm 103 to bias and upwardly support the lever arm 103 all the time. Lever cams 155 are formed on the lever shaft 101 to move the paper wall 150 back and forth. The lever cams 155 are formed in the shape and number thereof corresponding to cam grooves 153 formed on the paperwall 150.

Figure 8A:
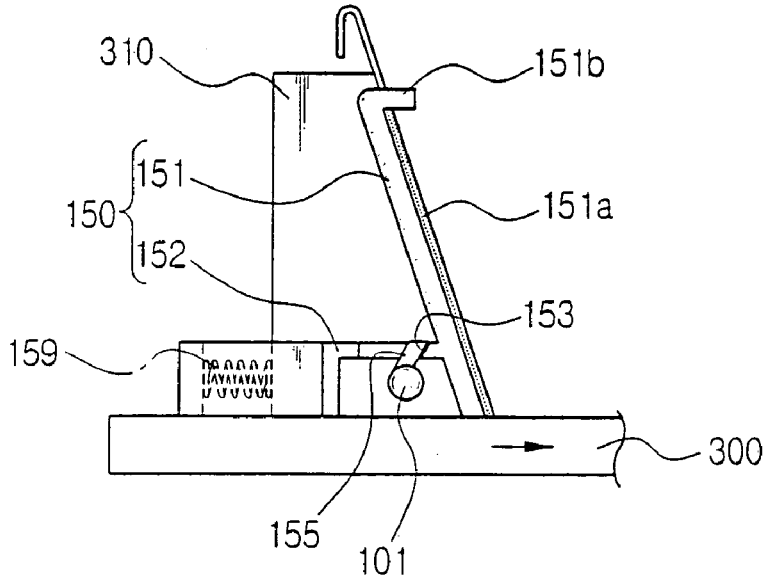
FIG. 8A is a cross-sectioned view, taken along lines 1—1 of FIG. 7, for showing a state that a paper wall is moved forward in the paper insertion limiting device for a paper feeding unit according to the second embodiment of the present invention.

The paper wall 150 is constructed with a paper rejecter 151 and an actuator 152. The paper rejecter 151 prevents papers loaded in the paper feeding unit 300 from being inserted further, has a slope similar to a slope of the paper dam 310, and has a resistance layer 151 a formed on the surface thereof. The resistance layer 151*a* prevents the front ends of papers from being slid along the paper rejecter 151 to be inserted to the drive roller 320 so that it has a large contact resistance against the front ends of papers. In general, the resistance layer 151*a* is formed of a plurality of protrusions or serrations formed, or a substance having a large surface resistance applied. Sponge may be used as the substance having a large surface resistance. Further, it is preferable that the front end 151*b* of the paper resister 151 is formed to be protruded over the resistance layer 151*a* as shown in FIG. 8A so that the front ends of the papers slid over the resistance layer 151*a* are caught.

The actuator 152 is mounted over the lever cam 155 and moves the paper rejecter 151 back and forth against the paper dam 310 according to the rotation of the lever cam 155, and the cam grooves 153 are formed in the upper surface of the actuator 152. The cam grooves 153 converts the rotational movements of the lever shaft 101 into the linear movements of the paper wall 150 in association with the lever cams 155. At this time, as the lever shaft 101 rotates in the clockwise direction as shown by an arrow A3 (FIG. 6), the cam grooves 153 interact with the lever cam 155 to move the paper restrainer 151 to the right as shown by an arrow (FIG. 8A), and, when the lever shaft 101 revolves in the opposite direction, the cam grooves 153 do not interact with the lever cam 155. A movement biasing element 159 is inserted between the back of the paper dam 310 and the actuator 152. The movement biasing element 159 exerts a force to move the actuator 152 to the left as shown by an arrow (FIG. 8B) all the time. Such an actuator 152 is installed at the left and right sides of one paper dam 310 in symmetry, as shown in FIG. 7, for stable back and forth movements.

The regulating member activator 200 actuates the sheet regulating member 100' when the carrier 300 (FIG. 6) reaches a certain position, which is the same as the regulating member actuator for the paper insertion limiting device of the paper feeding unit according to the first embodiment as described above, so the detailed description on it will be omitted.

Figure 8B:
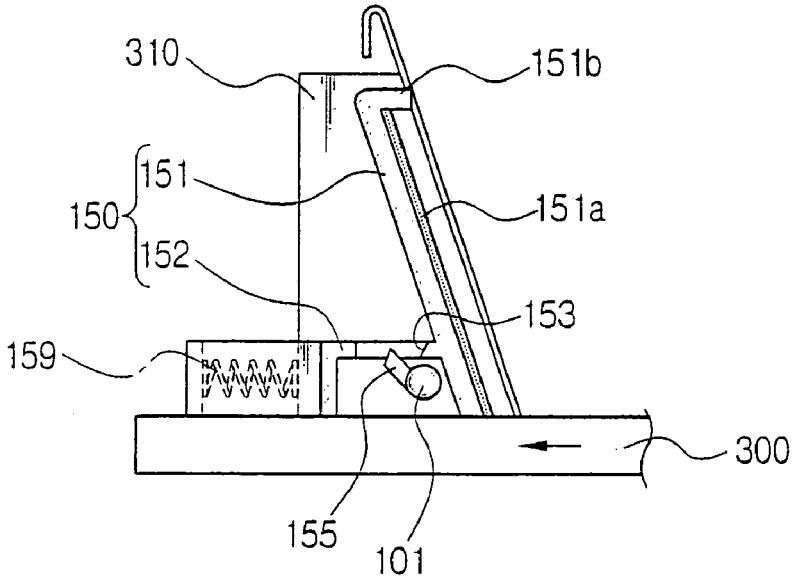
FIG. 8B is a cross-sectioned view for showing a state that the paper wall is moved back from FIG. 8A.

Operations of the paper insertion limiting device of the paper feeding unit according to the second embodiment of the present invention will be described with reference to FIG. 7 to FIG. 8B as follows. However, operations of the regulating member activator 200 will be described with reference to FIG. 3 and FIG. 6.

First, where papers are loaded in the paper feeding unit 300 of an inkjet printer, the carrier 330 (FIG. 6) moves to the home position. When the carrier 330 reaches the home position, the actuating piece 331 (FIG. 6) pushes the cam 208 of the regulating member activator 200 to the left as shown by an arrow A4 (FIG. 6). When the cam 208 is pushed to the left, the regulating member activator 200 rotates to the counterclockwise direction about the pivot 203. When the regulating member activator 200 rotates in the counterclockwise direction, the guide pin 105 of the sheet regulating member 100 inserted in the guide slit 205 receives a downward force as shown by an arrow A3 (FIG. 6). When the guide pin 105 is pressed down by the guide slit 205, the spring 110 positioned at the bottom of the lever arm 103 is pressed and then the lever shaft 101 revolves in the clockwise direction. When the lever shaft 101 revolves in the clockwise direction, the lever cam 155 rotates in the clockwise direction to push the cam grooves 153 of the paper wall 150 to the right as shown by an arrow (FIG. 8A). When the cam grooves 153 are pushed to the right, the paper wall 150 moves to the right, and the paper restrainer 151 is placed in line of the paper dam 310 of the paper feeding unit 300. At this time, since the resistance layer 151*a* is formed on the paper restrainer 151, papers loaded in the paper feeding unit 300 are prevented from being inserted to the drive roller 320 (FIG. 8A).

Where papers are completely loaded and the carrier 330 performs printing, the carrier 330 comes out of the home position. When the carrier 330 comes out of the home position, the actuating piece 331 is separated from the cam 208. When the actuating piece 210 comes out of the cam 208, the lever arm 103 of the sheet regulating member 100' rotates in the counterclockwise direction as shown by an arrow A1 (FIG. 3) by a restoring force of the spring 110 which has been compressed through the regulating member activator 200. When the lever arm 103 rotates in the counterclockwise direction, the lever shaft 101 revolves in the counterclockwise direction so that the lever cam 155 is released from the cam grooves 153. As the lever cam 155 is released from the cam grooves 153, the paper wall 150 moves to the left by the movement spring 159 inserted between the paper dam 310 and the actuator 152 so that the paper restrainer 151 is retreated from the paper dam 310. Thereafter, the papers loaded in the paper feeding unit 300 are picked up by the pickup roller 315, separated by a paper by the paper dam 310, and fed to the drive roller 320. At this time, when the lever arm 103 rotates in the counterclockwise direction by the spring 110, the regulating member activator 200 rotates in the clockwise direction as shown by an arrow A2 (FIG. 3) by the guide pin 105 and the guide slit 205 so that the cam 208 gets ready to meet the actuating piece 331 (FIG. 6)

As the carrier 330 finishes printing and returns to the home position, the actuating piece 331 actuates the cam 208 again so that the paper wall 150 blocks the front ends of the papers through the above operations.

Figure 9A:
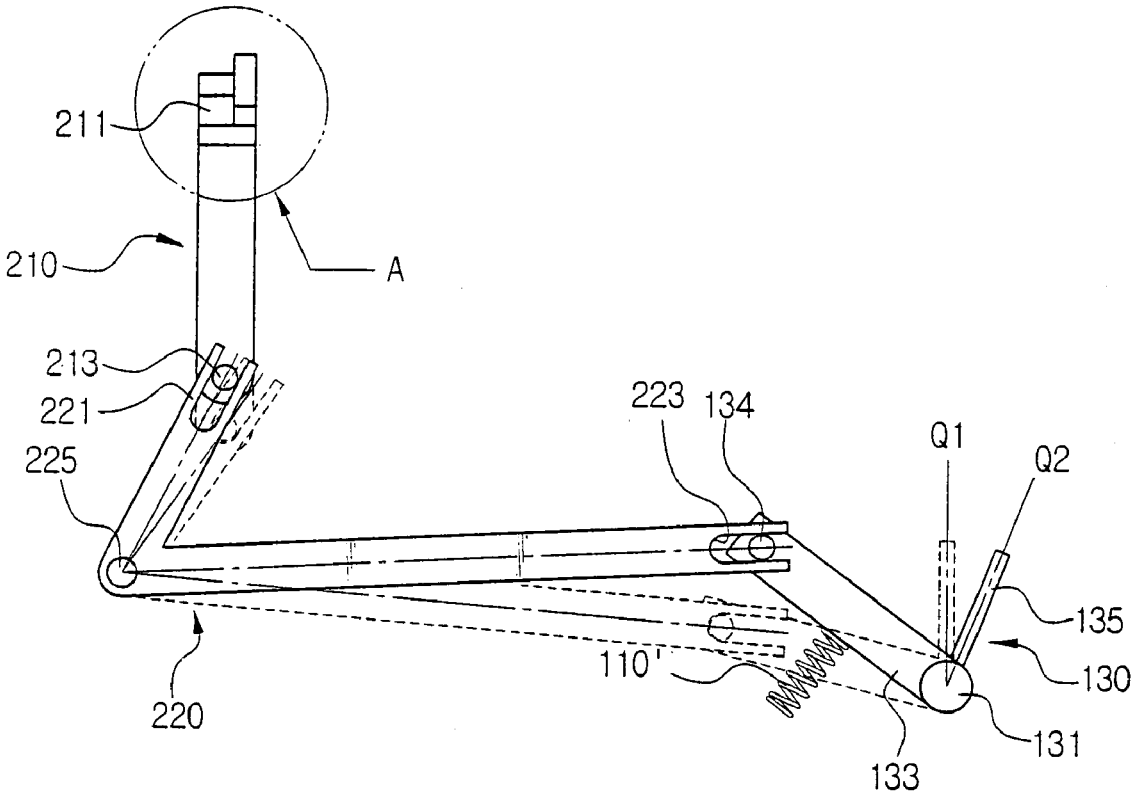
FIG. 9A is a side view for showing a paper insertion limiting device for a paper feeding unit according to a third embodiment of the present invention.

Further, FIG. 9A is a view to show a paper insertion limiting device of a paper feeding unit according to a third embodiment of the present invention, omitting the paper feeding unit, carrier, drive roller, and the like.

The paper insertion limiting device of a paper feeding unit according to the third embodiment includes a first link 210, a second link 220, and a sheet regulating member 130.

Figure 9B:
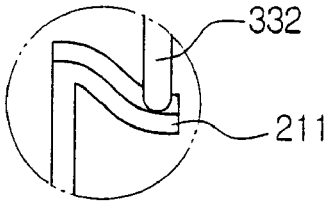
FIG. 9B is an enlarged view of the main portion of the paper insertion limiting device of FIG. 9A.

The first link 210 has a cam 211 on one end thereof to convert the liner movements of the carrier 330 to linear movements in a direction perpendicular to the movement direction of the carrier 330 (refer to FIG. 9B to observe a cam shape, showing a plan view of the cam in circle A of FIG. 9A). A first guide pin 213 is formed on the other end of the first link 210. The second link 220 converts the linear movements of the first link 210 into rotational movements, which is mounted by a pivot 225 on the printer main body. First and second guide grooves 221 and 223 are formed on both ends of the second link 220, and the guide grooves 221 and 223 are inserted in the first guide pin 213 and the second guide pin 134 respectively. The sheet regulating member 130 includes a lever shaft 131, a paper wall 135, and a lever arm 133, and the lever arm 133 has the second guide pin 134 formed to be inserted in the second guide groove 223 of the second link 220.

Accordingly, when the carrier 332 comes in contact with the cam 211, the first link 210 is pushed down so that the second link 220 rotates in the clockwise direction. When the second link 220 rotates in the clockwise direction, the sheet regulating member 130 rotates in the counterclockwise direction so that the paper wall 135 blocks the front ends of papers (refer to the position Q1 of FIG. 9A). When the carrier 332 falls apart from the cam 211, the sheet regulating member 130 returns by a spring 110' to the paper feeding position (refer to the position Q2 of FIG. 9A) at which papers are fed, so the second link 220 rotates in the counterclockwise direction to return the first link 210 upward. That is, the operations of the second embodiment are the same as those of the first embodiment except that the regulating member activator 200 is formed with the two links 210 and 220.

Figure 10:
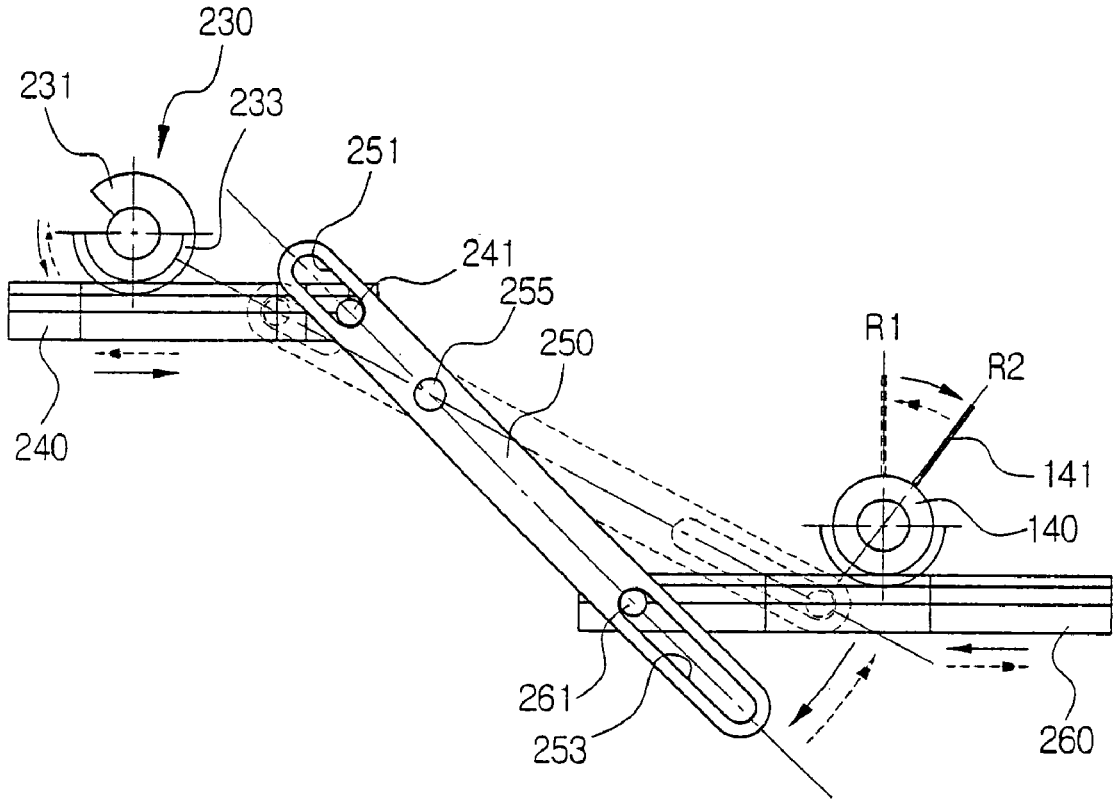
FIG. 10 is a side view for showing a paper insertion limiting device for a paper feeding unit according to a fourth embodiment of the present invention.

Further, FIG. 10 is a view to show a paper insertion limiting device of a paper feeding unit according to the fourth embodiment of the present invention.

The paper insertion limiting device of the fourth embodiment includes a cam gear 230, a first rack gear 240, a lever 250, a second rack gear 260, a regulating gear 140, and a paper wall 141.

The cam gear 230 is mounted in parallel with the movement direction of the carrier, has a cam part 231 formed on one end thereof to convert the linear movements of the carrier into a rotational movements, and also has a gear part 233 formed on the other end thereof. The carrier has a cam follower mounted together with the cam part 231 of the cam gear 230 to convert the linear movements of the carrier into the rotational movements. The first rack gear 240 is meshed with the gear part 233 of the cam gear 230 to convert the rotational movements of the cam gear 230 into the linear movements. A third guide pin 241 is protruded on one end of the first rack gear 240. The lever 250 converts the linear movements of the first rack gear 240 into the rotational movements, which is rotatably mounted by the pivot 255 on the main body in which the paper feeding unit is installed, and has a third guide groove 251 formed on one end thereof in which the third guide pin 241 of the first rack gear 240 is inserted and a fourth guide groove 253 formed on the other end thereof in which a fourth guide pin 261 of the second rack gear 260 is inserted. The second rack gear 260 converts the rotational movements of the lever 250 into the linear movements, which has the fourth guide pin 261 protruded on one end thereof. The regulating gear 140 is meshed with the second rack gear 260, and converts the linear movements of the second rack gear 260 into the rotational movements. The paper wall 141 is formed in line of the axis of the regulating gear 140, blocking the front ends of papers according to the rotations of the regulating gear 140.

When the carrier moves to the home position, the cam gear 230 rotates in the clockwise direction by the cam follower and the cam 231. When the cam gear 230 rotates, the gear 233 rotates in the clockwise direction so that the first rack gear 240 meshed with the gear 233 linearly moves to the left. When the first rack gear 240 moves to the left, the lever 250 rotates in the counterclockwise direction about the pivot 255 by the third guide pin 241 and the third guide groove 251. When the lever 250 rotates in the counterclockwise direction, the second rack gear 260 linearly moves to the right by the fourth guide pin 261 and the fourth guide slit 253. When the second rack gear 260 linearly moves to the right, the regulating gear 140 rotates in the counterclockwise direction. When the regulating gear 140 rotates in the counterclockwise direction, the paper wall 141 rotates in the counterclockwise direction to a position R1, to thereby prevent the front ends of papers from being further inserted.

To the contrary, when the carrier moves out of the home position, the cam gear 230 rotates in the counterclockwise direction by the cam follower and the cam 231. When the cam gear 230 rotates, the gear 233 rotates in the counterclockwise direction so that the first rack gear 240 meshed with the gear 233 linearly moves to the left. When the first rack gear 240 moves to the left, the lever 250 rotates in the clockwise direction about the pivot 255 by the third guide pin 241 and the third guide groove 251. When the lever 250 rotates in the clockwise direction, the second rack gear 260 linearly moves to the right by the fourth guide pin 261 and the fourth guide slit 253. When the second rack gear 260 linearly moves to the right, the regulating gear 140 rotates in the clockwise direction. When the regulating gear 140 rotates in the clockwise direction, the paper wall 141 rotates in the clockwise direction and returns to the same position as the paper dam, that is, a position R2, to thereby feed papers.

That is, in the paper insertion limiting device according to the fourth embodiment of the present invention, when the carrier reaches the home position, the regulating gear 140 rotates so that the paper wall 141 blocks the front ends of papers, and, when the carrier moves out of the home position, the regulating gear 140 rotates in the opposite direction so that the paper wall 141 is placed to feed papers.

Even though not described in detail before, a device rotating to a certain angle the paper wall mounted on the paper feeding unit by employing various power transmission units such as gears, cams, links, and so on to transmit power so that the carrier moves to and out of the home position pertains to the scope of the present invention.

As aforementioned, the paper insertion limiting device of a paper feeding unit according to the present invention does not produce occasions that papers are inserted to the drive roller when the papers are loaded in the paper feeding unit. Further, no noise is generated as well as the pickup condition becomes constant, since the loaded papers are pressed to the pickup roller by the pressing plate all the time so that the papers do not ascend and descend. In particular, it has an advantage of a low manufacturing cost due to less component parts. Further, it has an advantage that there is no need to additionally control a motor to load papers since the paper wall is actuated by using the operations returning the carrier to the home position.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A paper insertion limiting device of a paper feeding unit, using a movement of a carrier which is mounted with an ink cartridge and moving to the left and right to print, comprising:

a sheet regulating member mounted on a front end of the paper feeding unit to regulate an insertion depth of papers loaded in the paper feeding unit; and a regulating member activator to actuate the sheet regulating member to block front ends of papers when the carrier reaches a certain position, and to feed papers when the carrier moves out of the certain position;

wherein the sheet regulating member forms a right angle to a face of papers when the carrier reaches the certain position, and the sheet regulating member forms an obtuse angle to the paper when the carrier moves out of the certain position.

2. The paper insertion limiting device as claimed in claim 1, wherein the certain position is a home position where the carrier is placed while waiting to begin printing.

3. A paper insertion limiting device of a paper feeding unit, using a movement of a carrier which is mounted with an ink cartridge and moving to the left and right to print, comprising:

a sheet regulating member mounted on a front end of the paper feeding unit to rotate by a certain angle to regulate an insertion depth of papers loaded in the paper feeding unit; and a regulating member activator to actuate the sheet regulating member to block front ends of papers when the carrier reaches a certain position, and to feed papers when the carrier moves out of the certain position;

wherein the sheet regulating member forms a right angle to a face of papers when the carrier reaches the certain position, and the sheet regulating member forms an obtuse angle to the papers when the carrier moves out of the certain position.

4. The paper insertion limiting device as claimed in claim 3, wherein the certain position is a home position where the carrier is placed while waiting to print.

5. A paper insertion limiting device of a paper feeding unit mounted to a main body of a printer having a carrier which is mounted with an ink cartridge and moving to the left and right to print, comprising:

a sheet regulating member mounted on a front end of the paper feeding unit to rotate by a certain angle to regulate an insertion depth of papers loaded in the paper feeding unit; and a regulating member activator rotatably mounted on the main body in which the paper feeding unit is mounted, one end of the regulating member activator being directly connected to the sheet regulating member, and the other end of the same being actuated by the carrier, wherein the regulating member activator rotates to a certain angle so that the sheet regulating member is placed to block front ends of papers when the carrier reaches a home position, and the sheet regulating member is placed to feed papers when the carrier moves out of the home position;

wherein the sheet regulating member includes:

a lever shaft rotatably mounted on the front end of the paper feeding unit;

a lever arm protruded from the lever shaft and connected to one end of the regulating member activator; and a paper wall formed from the lever shaft to block the front ends of papers when the carrier enters the home position, and to feed papers when the carrier moves out of the home position.

6. The paper insertion limiting device as claimed in claim 5, wherein a guide pin is provided on the lever arm of the sheet regulating member, one end of the regulating member activator is provided with a guide slit, and the guide pin is inserted in the guide slit.

7. The paper insertion limiting device as claimed in claim 6, wherein a spring is mounted on the bottom of the lever arm.

8. The paper insertion limiting device as claimed in claim 5, wherein a cam is formed on the other end of the regulating member activator to rotate the regulating member activator to a certain angle according to movements of the carrier.

9. The paper insertion limiting device as claimed in claim 8, wherein an actuating piece is mounted on the carrier to actuate the cam.

10. The paper insertion limiting device as claimed in claim 9, wherein the sheet regulating member forms a right angle to the face of papers when the actuating piece actuates the cam, and the sheet regulating member forms an obtuse angle with the face of papers when the actuating piece is separated from the cam.

11. A paper insertion limiting device of a paper feeding unit mounted to a main body of a printer having a carrier which is mounted with an ink cartridge and moving to the left and right to print, comprising:

a sheet regulating member mounted on a front end of the paper feeding unit to rotate by a certain angle to regulate an insertion depth of papers loaded in the paper feeding unit; and a regulating member activator rotatably mounted on the main body in which the paper feeding unit is mounted, one end of the regulating member activator being directly connected to the sheet regulating member, and the other end of the same being actuated by the carrier, wherein the regulating member activator rotates to a certain angle so that the sheet regulating member is placed to block front ends of papers when the carrier reaches a home position, and the sheet regulating member is placed to feed papers when the carrier moves out of the home position;

wherein the regulating member activator includes:

a cam gear mounted in parallel with a movement direction of the carrier, and operated by the carrier;

a first rack gear meshed with the cam gear, and for converting rotation movements of the cam gear into linear movements;

a lever rotatably mounted on the main body in which the paper feeding unit is mounted, and one end of the lever is connected to the first rack gear to convert the linear movements of the first rack gear into rotational movements;

a second rack gear connected to the other end of the lever, and for converting the rotational movements of the lever into the linear movements;

a regulating gear meshed with the second rack gear, and for converting the linear movements of the lever into the rotational movements; and a paper wall mounted in line of an axis of the regulating gear, and for blocking the front ends of papers according to rotations of the regulating gear, the paper wall being placed to block the front ends of papers when the carrier enters the home position and to feed paper when the carrier moves out of the home position.

12. The paper insertion limiting device as claimed in claim 11, wherein the carrier has a cam follower to rotate the cam gear.

13. A paper insertion limiting device of a printer, including paper to be fed into the printer, comprising:

a carrier, to move in linear directions, including an actuating piece connected thereto;

a sheet regulating member, including a guide pin on a rotatable lever arm and a paper wall having a biasing element attached thereto, to rotate with the lever arm so as to occupy a paper blocking position in which the biasing element exerts a greater rotational force on the paper wall than the lever arm and a paper feeding position in which the lever arm exerts a greater rotational force on the paper wall than the biasing element;

a regulating member activator, including a cam to communicate with the actuating piece and a guide slit in which the guide pin slides, to convert the linear movement of the carrier to the rotational movement of the sheet regulating member.

14. The device according to claim 13, wherein the cam of the regulating member activator is spaced a short distance from the carrier at a first end of the cam and is spaced a long distance from the carrier at a second end of the cam.

15. A paper insertion limiting device of a printer, including paper to be fed into the printer, comprising:

a carrier, to move in linear directions;

a sheet regulating member including a lever arm, having a second guide pin and a biasing element connected thereto, and a paper wall which rotate together;

a regulating member activator, including a first link having a cam to communicate with the carrier in a first end and a first guide pin in a second end, and a second link having a first guide slit in which the first guide pin slides and a second guide slit in which the second guide pin slides, to convert a linear movement of the carrier to a rotational movement of the sheet regulating member.

16. The device according to claim 15, wherein the sheet regulating member comprises a lever shaft to provide communication between the lever arm and the paper wall.

* * * * *